US010550697B2

(12) United States Patent
Koda

(10) Patent No.: US 10,550,697 B2
(45) Date of Patent: Feb. 4, 2020

(54) STEAM TURBINE

(71) Applicant: MITSUBISHI HEAVY INDUSTRIES COMPRESSOR CORPORATION, Tokyo (JP)

(72) Inventor: Takuro Koda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 168 days.

(21) Appl. No.: 15/572,521

(22) PCT Filed: Aug. 21, 2015

(86) PCT No.: PCT/JP2015/073511
§ 371 (c)(1),
(2) Date: Nov. 8, 2017

(87) PCT Pub. No.: WO2017/033226
PCT Pub. Date: Mar. 2, 2017

(65) Prior Publication Data
US 2018/0135414 A1 May 17, 2018

(51) Int. Cl.
*F01D 5/06* (2006.01)
*F01D 3/00* (2006.01)
(Continued)

(52) U.S. Cl.
CPC ..... *F01D 3/00* (2013.01); *F01D 5/06* (2013.01); *F01D 5/085* (2013.01); *F01D 5/3007* (2013.01);
(Continued)

(58) Field of Classification Search
CPC ... F01D 3/00; F01D 5/06; F01D 5/085; F01D 5/3007; F05D 2220/31; F05D 2240/242; F05D 2240/30; F05D 2240/81
See application file for complete search history.

(56) References Cited

U.S. PATENT DOCUMENTS 2,430,185 A * 11/1947 Prescott ..... F01D 5/3053 403/376
2,974,924 A * 3/1961 Rankin ..... F01D 5/225 415/173.7
(Continued)

FOREIGN PATENT DOCUMENTS

EP 2 151 545 A2 2/2010
EP 2 208 859 A2 7/2010
(Continued)

OTHER PUBLICATIONS

International Search Report issued in corresponding International Application No. PCT/JP2015/073511 dated Nov. 17, 2015 (4 pages).
(Continued)

*Primary Examiner* — Moshe Wilensky
*Assistant Examiner* — Theodore C Ribadeneyra
(74) *Attorney, Agent, or Firm* — Osha Liang LLP

(57) ABSTRACT

A steam turbine includes: a rotor shaft including a shaft core that rotates about an axis and disk portions that are fixed to the shaft core and expand toward a radially outer side in the shaft core; and a plurality of rotor blades that are fixed to outer peripheries of the disk portions and are disposed in a circumferential direction of the shaft core. A first surface that is toward a first direction including a directional component toward a radially inner side of the shaft core is formed on each of the rotor blades, and a second surface that is toward a second direction including a directional component toward the radially outer side and faces the first surface is formed on each of the disk portions.

5 Claims, 5 Drawing Sheets

(51) Int. Cl.
*F01D 5/08* (2006.01)
*F01D 5/30* (2006.01)

(52) U.S. Cl.
CPC .... *F05D 2220/31* (2013.01); *F05D 2240/242* (2013.01); *F05D 2240/30* (2013.01); *F05D 2240/81* (2013.01); *F05D 2260/15* (2013.01)

(56) References Cited

U.S. PATENT DOCUMENTS 3,313,519 A * 4/1967 Jenson ..... F01D 5/30 416/217
5,110,262 A * 5/1992 Evans ..... F01D 5/3007 416/219 R
5,129,786 A * 7/1992 Gustafson ..... B64C 11/04 416/205
5,141,401 A * 8/1992 Juenger ..... F01D 5/3007 416/219 R
5,368,444 A 11/1994 Anderson
5,435,693 A * 7/1995 Shaffer ..... F01D 5/3053 416/204 A
5,554,005 A * 9/1996 Nguyen ..... F01D 5/3007 416/219 R
6,033,185 A * 3/2000 Lammas ..... F01D 5/3038 416/193 A
6,932,575 B2 * 8/2005 Surace ..... F01D 5/22 416/193 A
8,221,083 B2 * 7/2012 Alvanos ..... F01D 5/3007 416/219 R
8,662,852 B2 * 3/2014 Bhokardole ..... F01D 5/3007 416/218
9,546,556 B2 * 1/2017 Beattie ..... F01D 5/3007
9,903,213 B2 * 2/2018 Bluck ..... F01D 5/02
10,012,096 B2 * 7/2018 Kim ..... F01D 5/303
10,287,898 B2 * 5/2019 Bluck ..... F01D 5/3007
2005/0232751 A1 10/2005 Townes et al.
2008/0095632 A1 4/2008 Phipps
2014/0044549 A1 * 2/2014 Steinhardt ..... F01D 5/3007 416/219 R
2017/0122117 A1 * 5/2017 Trappier ..... F01D 5/3007
2017/0218776 A1 * 8/2017 Thistle ..... F01D 5/147

FOREIGN PATENT DOCUMENTS

GB 2 409 240 A 6/2005
GB 2442 968 A 4/2008
JP S58-048901 U 4/1983
JP S61-037762 Y2 11/1986
JP S63-018101 A 1/1988
JP 2001-200702 A 7/2001

OTHER PUBLICATIONS

Written Opinion of the International Searching Authority issued in corresponding International Application No. PCT/JP2015/073511 dated Nov. 17, 2015 (6 pages).

* cited by examiner

STEAM TURBINE

TECHNICAL FIELD

The present invention relates to a steam turbine.

BACKGROUND ART

A steam turbine includes a rotor which rotates about an axis and a casing which covers the rotor. The rotor includes a rotor shaft which extends in an axial direction about an axis and a plurality of stages of rotor blade rows which are fixed to an outer periphery of the rotor shaft and are arranged in the axial direction. The steam turbine includes a stator vane row which is fixed to an inner periphery of the casing and is disposed on an upstream side of each stage of the plurality of stages of rotor blade rows.

In each of a plurality of rotor blade configuring the rotor blade row of each stage, a blade root of the rotor blade is embedded into an outer peripheral portion of a disk portion which extends from a shaft core portion of the rotor shaft toward a radially outer side.

In the rotor blade row of each stage, a pressure difference is generated between an upstream side and a downstream side thereof. A large force acts on the rotor in an axial direction (thrust direction) of the rotor by this pressure difference. Accordingly, a balance hole which communicates with the upstream side and the downstream side of the rotor blade row is formed in the disk portion, and thus, the pressure difference between the upstream side and the downstream side of the rotor blade row decreases, and the force in the thrust direction decreases.

Patent Document 1 discloses a configuration in which a gap is formed between a bottom portion of a blade groove fitted into a blade root of each rotor blade formed in a disk portion and the blade root of the rotor blade and this gap functions as a balance hole.

CITATION LIST

Patent Literature

[Patent Document 1] Japanese Unexamined Patent Application, First Publication No. 2001-200702

In a steam turbine, there is a so-called reactive type steam turbine in which a heat drop difference between the upstream side and the downstream side of the rotor blade row of each stage, that is, a change amount (a degree of reaction) of enthalpy in the rotor blade row of each stage increases. In this reactive type steam turbine, high efficiency can be realized, and thus, a diameter of a disk portion can decrease. However, in a case where the diameter of the disk portion decreases, in the configuration disclosed in Patent Document 1, it is difficult to largely secure the gap which can be formed between the blade root of the rotor blade and the bottom portion of the blade groove.

If the gap which functions as the balance hole is narrowed, a pressure loss increases when a working fluid passes through the gap from the downstream side of the rotor blade to upstream side thereof. As a result, a substantial flow rate of the working fluid decreases, and effects for decreasing the pressure difference between the upstream side and the downstream side of the rotor blade by the balance hole to decrease the force in the thrust direction acting on the rotor shaft decrease.

SUMMARY OF INVENTION

One or more embodiments of the present invention provide a steam turbine capable of decreasing the pressure difference between the upstream side and the downstream side of the rotor blade to decrease the force in the thrust direction acting on the rotor shaft.

A steam turbine, according to one or more embodiments, may include a rotor shaft which includes a shaft core portion which rotates about an axis and disk portions which are fixed to the shaft core portion and expands toward a radially outer side in the shaft core portion; and a plurality of rotor blades which are fixed to outer peripheries of the disk portions and are disposed in a circumferential direction of the shaft core portion, in which a first surface which is toward a first direction including a directional component toward a radially inner side of the shaft core portion is formed on each of the rotor blades, a second surface which is toward a second direction including a directional component toward the radially outer side and faces the first surface is formed on each of the disk portions, and a balance hole portion which is recessed to communicate in an axial direction in which the shaft core portion extends is formed in at least one of the first surface and the second surface.

According to the above-described configuration, a centrifugal force acts on the rotor blade by rotation about an axis of the rotor shaft. In this case, a support load of the rotor blade to which a centrifugal force is applied does not act on the first surface of the rotor blade toward the first direction including the directional component toward the radially inner side and the second surface of the disk portion facing the first surface. Accordingly, the balance hole portion having a sufficient opening area can be formed to be recessed on the first and second surfaces. Therefore, it is possible to decrease a pressure difference between a first side and a second side of the disk portion in an axial direction by the balance hole portion.

In the steam turbine according to one or more embodiments of the present invention, the rotor blade may include a blade body which extends in the radial direction, a platform which is provided on the radially inner side of the blade body, and a blade root which is provided on the radially inner side of the platform and is fitted into a blade groove formed in the disk portion, in which in the blade root, as the first surface, a blade root inner surface may be formed on an engaging protrusion portion which protrudes in the circumferential direction and engages with an engaging recessed portion formed in the blade groove, and in the disk portion, a blade groove outer surface may be formed on the engaging recessed portion as the second surface.

Accordingly, if a centrifugal force acts on the rotor blade by rotation about the axis of the rotor shaft, the surface of the blade root toward the radially outer side in the engaging protrusion portion and the surface of the blade groove toward the radially inner side in the engaging recessed portion abut on each other, and thus, the rotor blade is supported. In this case, a gap is formed between the blade root inner surface of the engaging protrusion portion and the blade groove outer surface of the engaging recessed portion. Accordingly, the balance hole portion can be formed on the blade root inner surface or the blade groove outer surface to which a support load of the rotor blade to which the centrifugal force is applied is not applied.

In the steam turbine according to one or more embodiments of the present invention, the balance hole portion may be formed on the radially outer side from a groove bottom portion which is formed on the radially innermost side of the blade groove.

In the disk portion of the steam turbine, a pressure increases as approaching the radially outer side on which the rotor blade is disposed. Accordingly, the balance hole portion is formed on the portion which is disposed on the radially outer side from the bottom portion of the blade groove and has a high pressure, and thus, it is possible to effectively decrease the pressure difference between the first side and the second side of the disk portion in the axial direction.

In the steam turbine according to one or more embodiments of the present invention, the rotor blade may include the blade body which extends in the radial direction, the platform which is provided on the radially inner side of the blade body, and the blade root which is provided on the radially inner side of the platform and is fitted into a blade groove formed in the disk portion, in which in the platform, a platform inner peripheral surface toward the radially inner side may be formed as the first surface, and in the disk portion, a rotor outer peripheral surface which faces the platform inner peripheral surface and is toward the radially outer side may be formed as the second surface, and the balance hole portion may be formed on the rotor outer peripheral surface.

Accordingly, the balance hole portion can be formed on the rotor outer peripheral surface which is the outermost peripheral portion in the region of the disk portion to which the support load of the rotor blade to which a centrifugal force is applied is not applied. Accordingly, the balance hole portion can be formed in the portion of the disk portion having the highest pressure, and thus, it is possible to more effectively decrease the pressure difference between the first side and the second side of the disk portion in the axial direction.

In the steam turbine according to one or more embodiments of the present invention, in the disk portion, a communication hole which communicates in the axial direction may be formed between the blade grooves adjacent to each other in the circumferential direction.

Accordingly, it is possible to effectively decrease the pressure difference between the first side and the second side of the disk portion in the axial direction by the communication hole between the blade grooves adjacent to each other in the circumferential direction in addition to the balance hole portion.

According to one or more embodiments of the above-described steam turbine, the balance hole portion recessed from at least one of the first surface of the rotor blade and the second surface of the disk portion is provided, and thus, it is possible to decrease the pressure difference between an upstream side and a downstream side of the rotor blade and it is possible to decrease a force in a thrust direction acting on the rotor shaft.

DETAILED DESCRIPTION OF EMBODIMENTS

Figure 1:
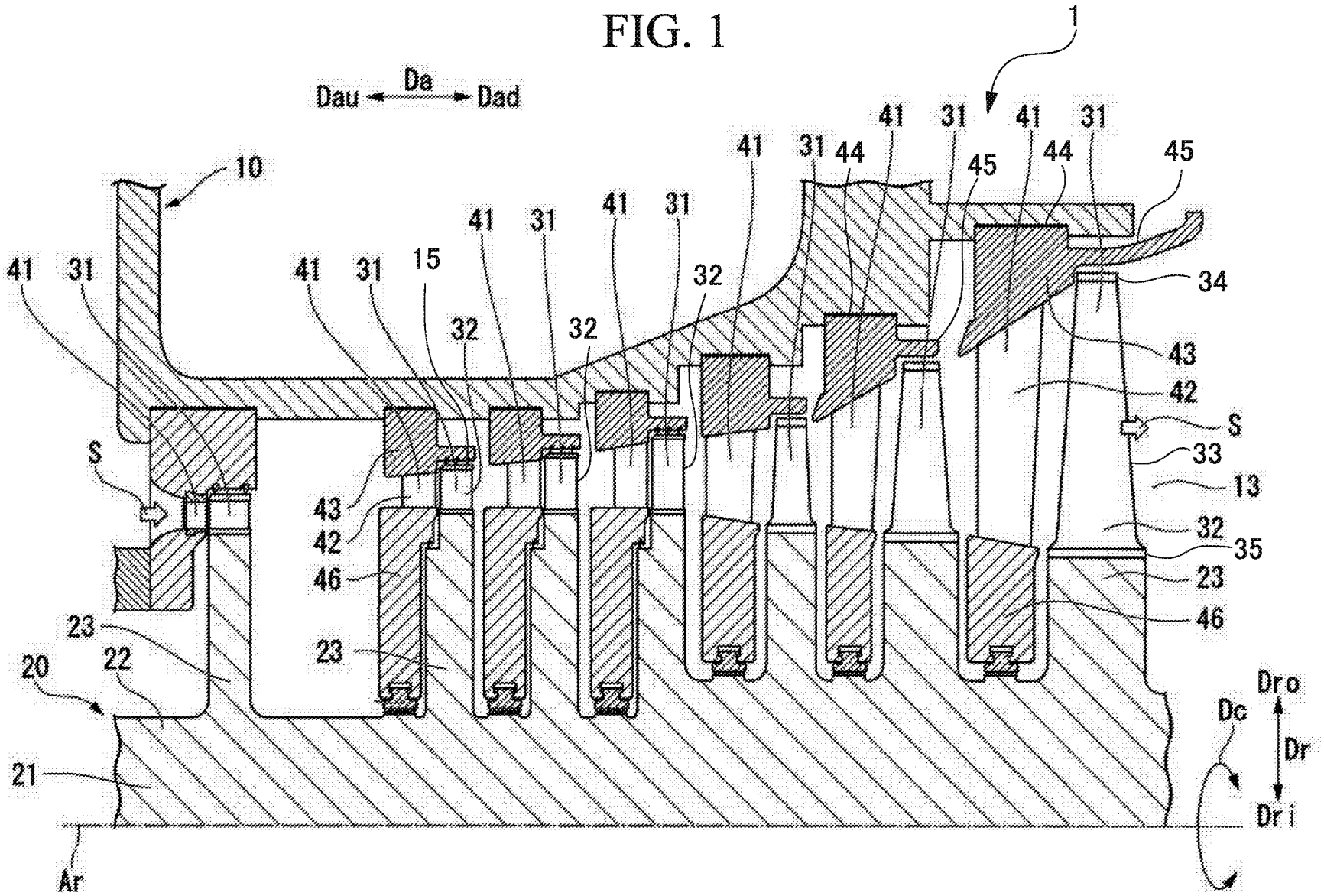
FIG. 1 is a sectional view of a steam turbine according to one or more embodiments of the present invention.
Figure 2:
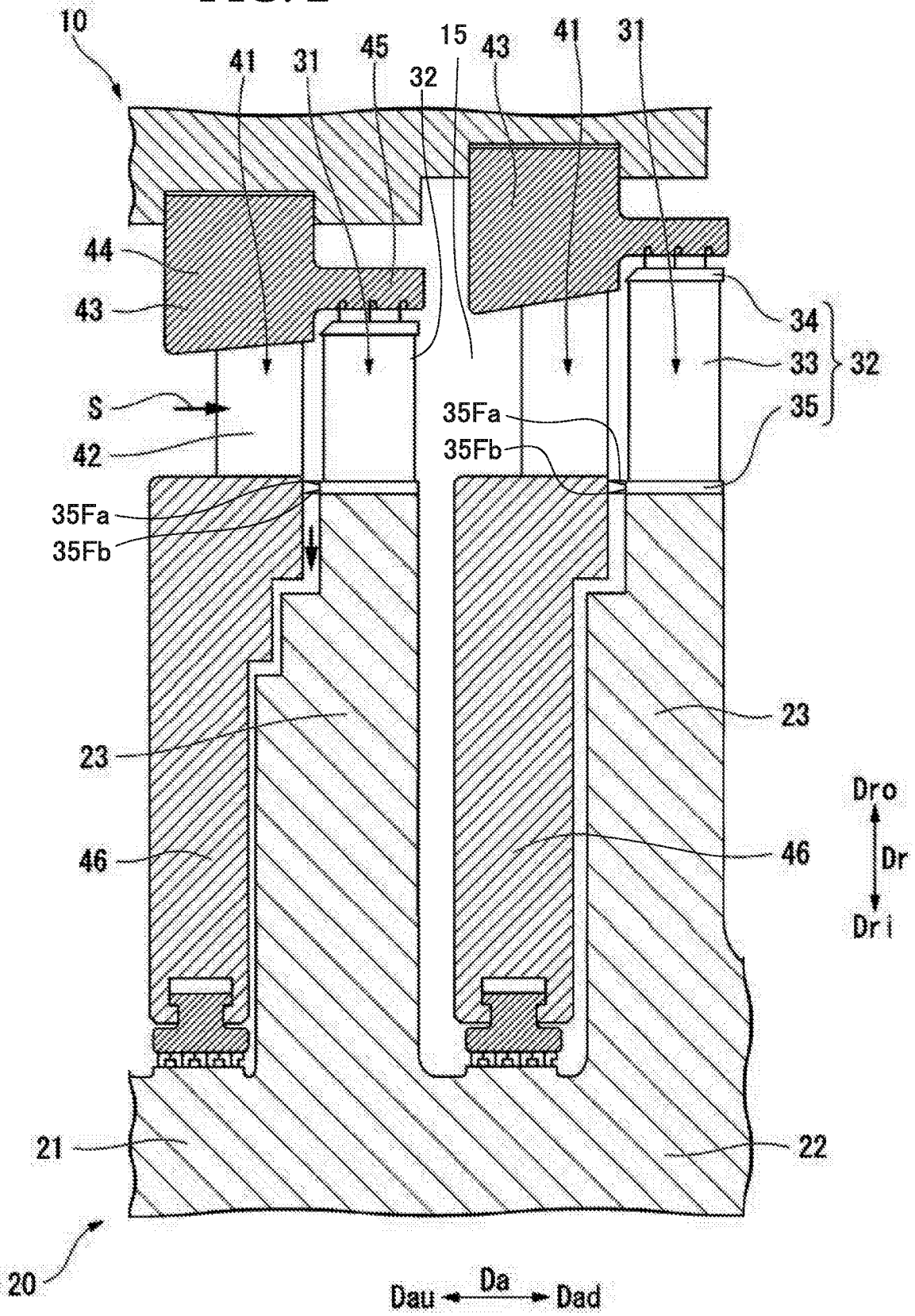
FIG. 2 is a sectional view of the steam turbine showing peripheries of rotor blades in an embodiment of the present invention.
Figure 3:
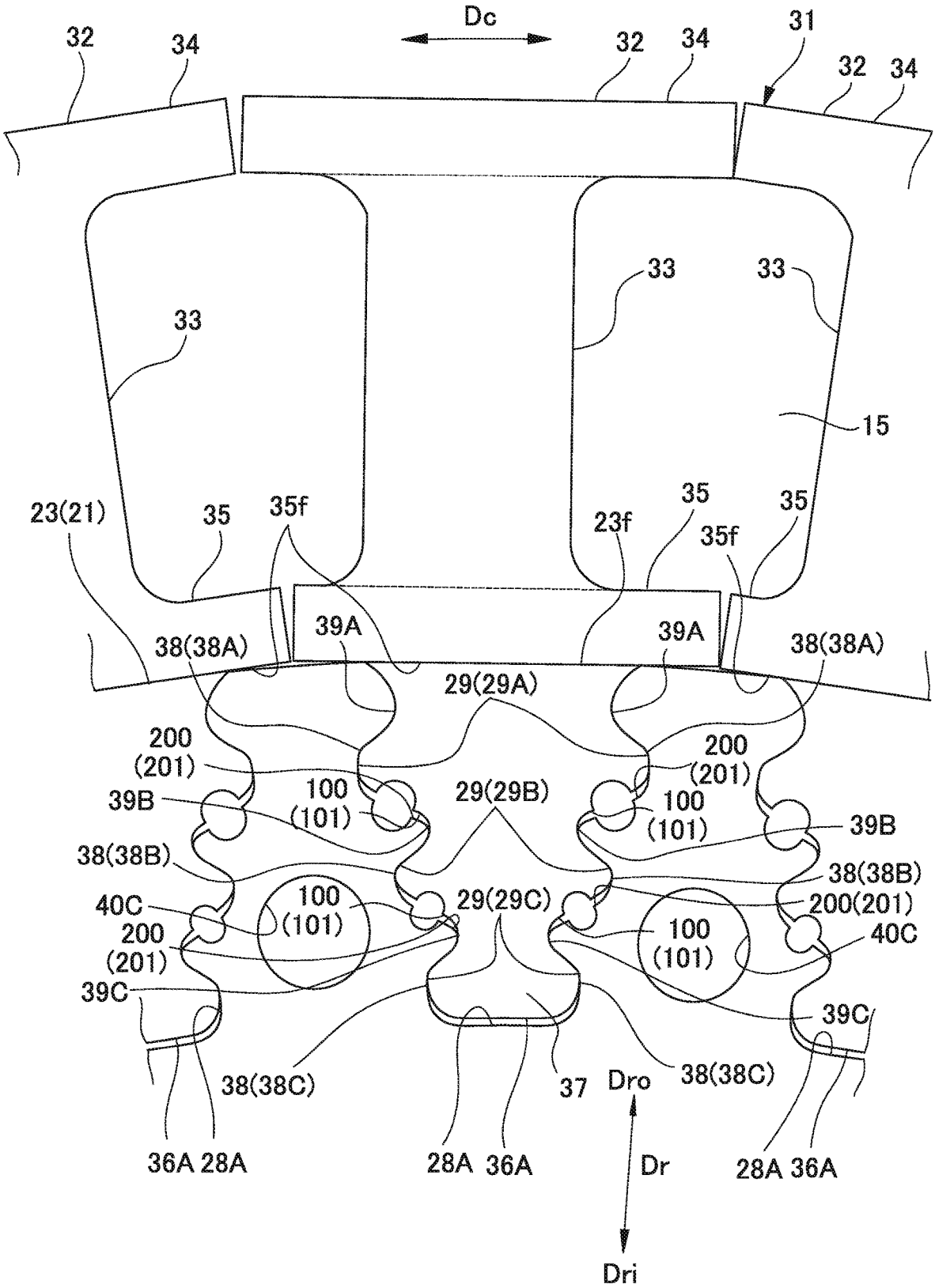
FIG. 3 is a sectional view showing balance hole portions formed in the rotor blades and disk portions in an embodiment of the present invention.
Figure 4:
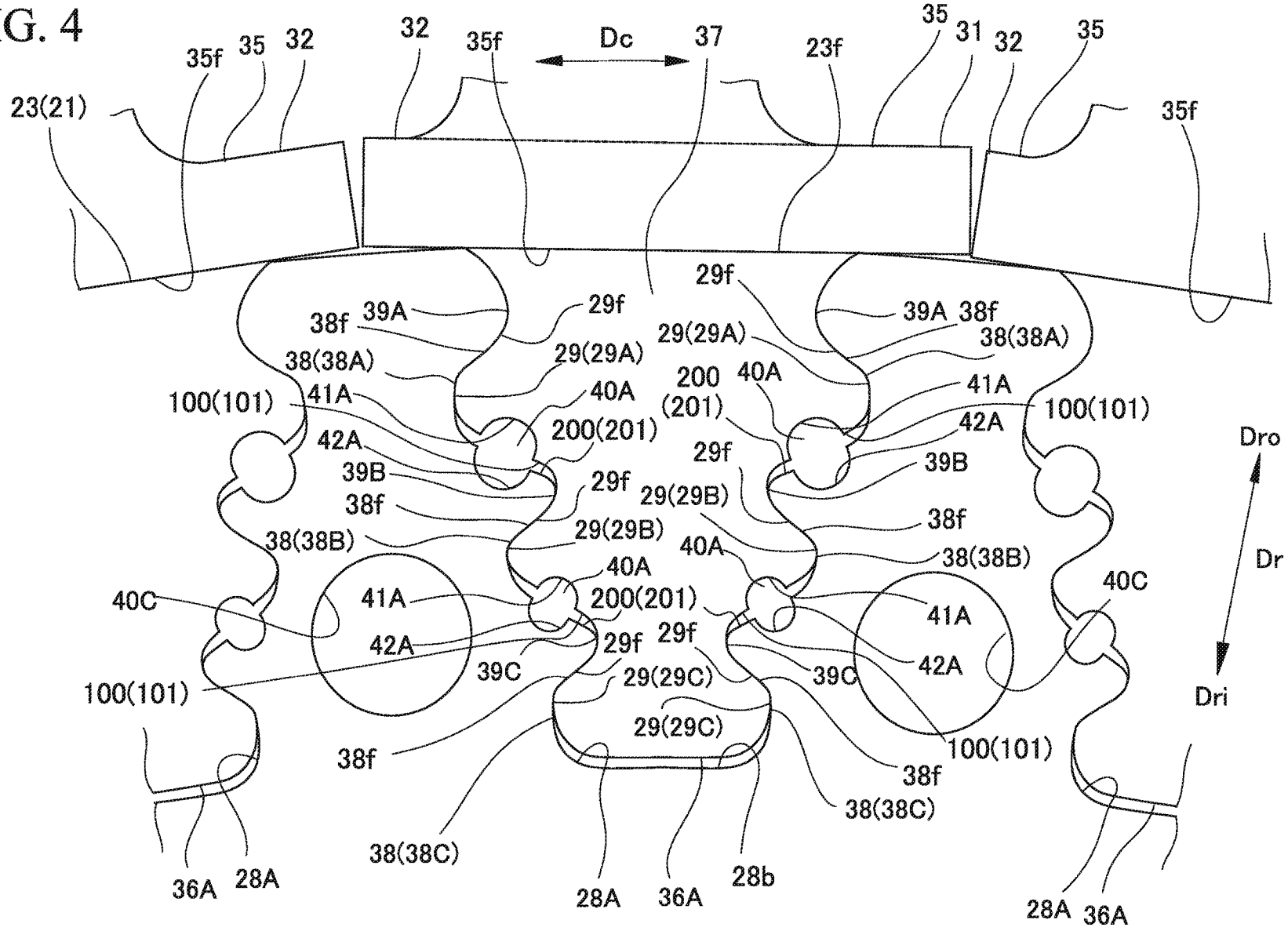
FIG. 4 is an enlarged sectional view showing the balance hole portions formed in the rotor blades and the disk portions in an embodiment of the present invention.

FIG. 1 is a sectional view of a steam turbine according to one or more embodiments of the present invention. FIG. 2 is a sectional view of the steam turbine showing peripheries of rotor blades an embodiment of the present invention. FIG. 3 is a sectional view showing balance hole portions formed in the rotor blades and disk portions in an embodiment of the present invention. FIG. 4 is an enlarged sectional view showing the balance hole portions formed in the rotor blades and the disk portions in an embodiment of the present invention.

As shown in FIG. 1, a steam turbine 1 of one or more embodiments may include a rotor 20 which rotates about an axis Ar and a casing 10 which covers the rotor 20 to be rotatable.

In addition, for convenience of the following descriptions, a direction in which the axis Ar extends is referred to an axial direction Da, a first side in the axial direction Da is referred to as an upstream side (one side, first side) Dau, and a second side in the axial direction Da is referred to as a downstream side (the other side, second side) Dad. Moreover, a radial direction in a shaft core portion 22 described later based on the axis Ar is simply referred to a radial direction Dr, a side close to the axis Ar in the radial direction Dr is referred to as a radially inner side Dri, and a side opposite to the radially inner side Dri in the radial direction Dr is referred to as a radially outer side Dro. In addition, a circumferential direction of the shaft core portion 22 about the axis Ar is simply referred to as a circumferential direction Dc.

The rotor 20 includes a rotor shaft 21 and a plurality of rotor blade rows 31 which are provided at intervals therebetween along the axial direction Da of the rotor shaft 21.

The rotor shaft 21 includes a shaft core portion 22 which is formed in a columnar shape about the axis Ar and extends in the axial direction Da, and a plurality of disk portions 23 which extend from the shaft core portion 22 toward the radially outer side Dro and are arranged at intervals therebetween in the axial direction Da. The disk portion 23 is provided for each of the plurality of rotor blade rows 31.

The rotor blade row 31 is attached to the outer periphery of the disk portion 23 which is an outer peripheral portion of the rotor shaft 21. The plurality of rotor blade rows 31 are provided at intervals therebetween along the axial direction Da of the rotor shaft 21. As shown in FIG. 1, the number of the rotor blade rows 31 is seven. Accordingly, as the rotor blade rows 31, first to seventh stages of rotor blade rows 31 are provided.

According to one or more embodiments, as shown in FIGS. 1 and 2, each rotor blade row 31 includes a plurality of rotor blades 32 which are arranged in the circumferential direction Dc. Each rotor blade 32 includes a blade body 33 which extends in the radial direction Dr, a shroud 34 which is provided on the radially outer side Dro of the blade body 33, a platform 35 which is provided on the radially inner side Dri of the blade body 33, and a blade root 36A (refer to FIGS. 3 and 4) which is provided on the radially inner side Dri of the platform 35. In the rotor blade 32, a portion between the shroud 34 and the platform 35 configures a portion of the steam main flow passage 15 through which steam S flows. The steam main flow passage 15 extends in the axial direction Da over the plurality of rotor blade rows 31 and the plurality of stator vane rows 41. The steam main flow passage 15 is formed in an annular shape around the rotor 20.

According to one or more embodiments, as shown in FIGS. 3 and 4, first surfaces 100 which are toward a first direction including a directional component toward the radially inner side Dri are formed in the rotor blade 32. The first surfaces 100 are formed in the blade root 36A.

In addition, the first direction may be any direction as long as it includes the directional component toward the radially inner side Dri, and may be a direction parallel to the radial direction Dr or a direction inclined to the radial direction Dr.

According to one or more embodiments, as shown in FIG. 2, in the platform 35 of the rotor blade 32, a pair of axial fins (seal portion) 35Fa and 35Fb are provided on the upstream side Dau in the axial direction Da. The axial fin 35Fa is formed to protrude from an end portion on the radially outer side Dro of the platform 35 to the upstream side Dau. The axial fin 35Fb is formed to protrude from an end portion on the radially inner side Dri of the platform 35 to the upstream side Dau. The clearance between the platform 35 and an inner ring 46 described later of the stator vane row 41 disposed on the upstream side Dau of the platform 35 is narrowed by the axial fins 35Fa and the axial fin 35Fb. Accordingly, the axial fins 35Fa and the axial fins 35Fb prevents the steam S from leaking from the steam main flow passage 15 toward the radially inner side Dri.

According to one or more embodiments, as shown in FIGS. 3 and 4, in each of the plurality of rotor blades 32 configuring the rotor blade row 31, as described later, the blade root 36A is fitted into a blade groove 28A formed on an outer peripheral portion of the disk portion 23 in the rotor shaft 21.

According to one or more embodiments, as shown in FIG. 1, in addition, the steam turbine 1 includes a plurality of stator vane rows 41 which are fixed to an inner periphery of the casing 10 and are provided at intervals therebetween along the axial direction Da. In one or more embodiments, the number of the stator vane rows 41 is seven which is the same as the number of the rotor blade rows 31. Accordingly, as the stator vane rows 41, first to seventh stages of stator vane rows 41 are provided. Each of the plurality of stator vane rows 41 is disposed to be adjacent to the upstream side Dau with respect to the rotor blade row 31.

According to one or more embodiments, as shown in FIGS. 1 and 2, the stator vane row 41 includes a plurality of stator vanes 42 which are arranged in the circumferential direction Dc, an annular outer ring 43 which is provided on the radially outer side Dro of the plurality of stator vanes 42, and the annular inner ring 46 which is provided on the radially inner side Dri of the plurality of stator vanes 42. That is, the plurality of stator vanes 42 are disposed between the outer ring 43 and the inner ring 46. The stator vanes 42 are fixed to the outer ring 43 and the inner ring 46. An annular space between the outer ring 43 and the inner ring 46 configures a portion of the steam main flow passage 15 through which the steam S flows. The outer ring 43 includes a ring body portion 44 to which the plurality of stator vanes 42 are fixed and a ring protrusion portion 45 which protrudes from the ring body portion 44 toward the downstream side Dad. The ring protrusion portion 45 faces the shroud 34 of the rotor blade row 31, which is adjacent to the downstream side Dad of the stator vane row 41, at an interval therebetween in the radial direction Dr.

According to one or more embodiments, as shown in FIGS. 3 and 4, in the steam turbine 1, the blade root 36A of each of the rotor blades 32 is formed to extend from a platform inner peripheral surface 35*f* which is toward the radially inner side Dri of the platform 35 toward the radially inner side Dri. The blade root 36A includes a blade root body 37 which extends from the platform inner peripheral surface 35*f* toward the radially inner side Dri and an engaging protrusion portion 38 which protrudes from the blade root body 37 toward both sides in the circumferential direction Dc. The engaging protrusion portion 38 protrudes from the blade root body 37 at a plurality of locations spaced apart along the radial direction Dr. The engaging protrusion portion 38 engages with an engaging recessed portion 29 described later which is formed on the blade groove 28A. In one or more embodiments, the engaging protrusion portion 38 is formed at three locations spaced apart along the radial direction Dr. Each of an engaging protrusion portion 38A, an engaging protrusion portion 38B, and an engaging protrusion portion 38C has a curved surface shape which protrudes in a direction separated from the center in the circumferential direction Dc of the blade root 36A along the circumferential direction Dc.

Here, compared to the engaging protrusion portion 38A on the platform 35 side, the engaging protrusion portion 38B and the engaging protrusion portion 38C disposed on the radially inner side Dri of the engaging protrusion portion 38A are formed such that protrusion dimensions thereof from the blade root body 37 in the circumferential direction Dc gradually decrease. In addition, in the blade root body 37, a first trunk 39A between the platform 35 and the engaging protrusion portion 38A, a second trunk 39B between the engaging protrusion portion 38A and the engaging protrusion portion 38B, and a third trunk 39C between the engaging protrusion portion 38B and the engaging protrusion portion 38C are formed such that width dimensions thereof in the circumferential direction Dc gradually decrease from the platform 35 side toward the radially inner side Dri. Accordingly, the blade root 36A is formed in a so-called Christmas tree shape.

In the engaging protrusion portion 38, blade root inner surfaces 101 are formed as the first surfaces 100. Each of the blade root inner surfaces 101 is a surface which is formed toward the radially inner side Dri in the engaging protrusion portion 38. The blade root inner surface 101 is toward a first direction. That is, the blade root inner surface 101 of one or more embodiments includes not only a surface toward the radially inner side Dri but also a surface toward a direction including a directional component toward the radially inner side Dri to be a curved surface to connect surfaces of the engaging protrusion portion 38 toward the circumferential direction Dc.

In the engaging protrusion portion 38, blade root outer surfaces 38*f* which are toward a direction including a directional component toward the radially outer side Dro are formed. Each of the blade root outer surfaces 38*f* is a surface which is formed on the radially outer side Dro in the engaging protrusion portion 38.

In the disk portion 23 of the rotor shaft 21, second surfaces 200 which are toward a second direction including a directional component toward the radially outer side Dro are formed. The second surfaces 200 face the first surface 100. In addition, the second direction may be any direction as long as it includes a directional component toward the radially outer side Dro, and similarly to the first surface 100, may be a direction parallel to the radial direction Dr or a direction inclined to the radial direction Dr. In such an embodiment, the second direction is parallel to the first direction and is a direction toward the direction different from the first direction.

In the disk portion 23, a blade groove 28A which recessed from the outer peripheral surface toward the radially inner side Dri is formed. The blade groove 28A is formed to be recessed from a rotor outer peripheral surface 23*f* which is formed on the radially outermost side Dro of the disk portion 23 and is toward the radially outer side Dro. The rotor outer peripheral surface 23*f* faces the platform inner peripheral surface 35*f*.

The blade groove 28A is formed to make up the outer peripheral surface of the blade root 36A. The blade groove 28A includes the engaging recessed portion 29 recessed toward both sides in the circumferential direction Dc at a plurality of locations spaced apart along the radial direction Dr. In such an embodiment, the engaging recessed portion 29 is provided on the radially outer side Dro from a bottom portion (groove bottom portion) 28*b* formed on the radially innermost side Dri of the blade groove 28A. The bottom portion 28*b* is a surface which is toward the radially outer side Dro in the blade groove 28A. The engaging recessed portion 29 is formed at three locations spaced apart along the radial direction Dr. Each of engaging recessed portion 29A, engaging recessed portion 29B, and engaging recessed portion 29C has a curved surface shape which is recessed in a direction separated from the center in the circumferential direction Dc of the blade groove 28A along the circumferential direction Dc.

In the engaging recessed portion 29, blade groove outer surfaces 201 are formed as the second surfaces 200. Each of the blade groove outer surfaces 201 is a surface is formed on the radially inner side Dri in the engaging recessed portion 29. The blade groove outer surface 201 is toward the second direction. That is, the blade groove outer surface 201 of such an embodiment includes not only a surface toward the radially outer side Dro but also a surface toward a direction including a directional component toward the radially inner side Dri to be a curved surface to connect surfaces of the engaging recessed portion 29 toward the circumferential direction Dc.

In the engaging recessed portion 29, blade groove inner surfaces 29*f* which are toward a direction including a directional component toward the radially inner side Dri are formed. Each of the blade groove inner surfaces 29*f* is a surface which is formed on the radially outer side Dro in the engaging protrusion portion 29.

Here, if the rotor shaft 21 rotates around the axis Ar, the rotor blades 32 pivot about the axis Ar of the rotor shaft 21 along with the disk portion 23 of the rotor shaft 21. Accordingly, a centrifugal force is applied to the rotor blades 32. Therefore, the rotor blades 32 are displaced toward the radially outer side Dro by the centrifugal force. As a result, the blade root outer surfaces 38*f* of the engaging protrusion portions 38A, 38B, and 38C abut on the blade groove inner surfaces 29*f* of the engaging recessed portions 29A, 29B, and 29C. That is, the rotor blade 32 is supported in a state where the blade root outer surfaces 38*f* of the blade root 36A and the blade groove inner surfaces 29*f* of the blade groove 28A come into contact with each other.

Meanwhile, the centrifugal force is generated in the rotor blades 32, and thus, a distance between the blade root inner surface 101 of each of the engaging protrusion portions 38A, 38B, and 38C and the blade groove outer surface 201 of each of the engaging recessed portions 29A, 29B, and 29C increases. As a result, a gap between each blade root inner surface 101 and each blade groove outer surface 201 increases.

In addition, in each of the engaging protrusion portions 38A, 38B, and 38C, a recessed portion 41A which is recessed toward the radially outer side Dro side is formed on the blade root inner surface 101 toward the radially inner side Dri. In addition, in each of the engaging recessed portions 29A, 29B, and 29C, a recessed portion 42A which is recessed toward the radially inner side Dri is formed on the blade groove outer surface 201 which is toward the radially outer side Dro. The recessed portion 42A is disposed at a position facing the recessed portion 41A.

A balance hole portion 40A which communicates with the upstream side Dau and the downstream side Dad of the disk portion 23 is formed by the recessed portion 41A and the recessed portion 42A. Steam flows from a high pressure side (upstream side Dau) with respect to the disk portion 23 to a low pressure side (downstream side Dad) with respect to the disk portion 23 through the balance hole portion 40A, and thus, a pressure difference between the upstream side and the downstream side of the rotor blade row 31 decreases, and a force in a thrust direction acting on the disk portion 23 decreases.

As shown in FIG. 2, the axial fins 35Fa and 35Fb are formed in the platform 35. Accordingly, steam is prevented from leaking from a gap between the rotor blade row 31 and the stator vane row 41 toward the radially inner side Dri. Accordingly, in one or more embodiments, the balance hole portion 40A is formed on the radially inner side Dri from the axial fins 35Fa and 35Fb.

In addition, in a region of the disk portion 23 of the radially inner side Dri relative to the platform 35, a pressure increases from the rotor shaft 21 toward the radially outer side Dro. Accordingly, the effects for decreasing the pressure difference by the balance hole portion 40A increase as the balance hole portion 40A is positioned on the radially outer side Dro of the disk portion 23. The balance hole portion 40A may be formed on the radially inner side Dri from the axial fins 35Fa and 35Fb and on the radially outer side Dro from the bottom portion 28*b* of the blade groove 28A. Particularly, the balance hole portion 40A may be provided in the engaging protrusion portion 38A which is formed on the radially outermost side Dro among the engaging protrusion portions 38. Except for the engaging protrusion portion 38C which is formed on the radially innermost side Dri among the engaging protrusion portions 38, the balance hole portions 40A are provided in the engaging protrusion portion 38A and the engaging protrusion portion 38B.

In addition, in the disk portion 23, a communication hole 40C which communicates with the upstream side Dau and the downstream side Dad of the disk portion 23 is formed between the blade grooves 28A adjacent to each other in the circumferential direction Dc. The communication hole 40C is formed on the radially inner side Dri from the axial fins 35Fa and 35Fb of the platform 35 and on the radially outer side Dro from the bottom portion 28*b* of the blade groove 28A. The communication hole 40C of one or more embodiments is formed in a circular shape and penetrates the disk portion 23 in the axial direction Da.

Moreover, in one or more embodiments, the shape of the communication hole 40C is not limited to the circular shape. That is, the shape of the communication hole 40C may have any shape as long as it penetrates the disk portion 23 in the axial direction Da. For example, the communication hole 40C may formed in an elliptical shape or a slit shape.

As described above, a centrifugal force acts on the rotor blades 32 by rotation about the axis of the rotor shaft 21. Support loads of the rotor blades 32 to which the centrifugal force is applied do not act on the blade root inner surfaces 101 of the blade roots 36A of the rotor blades 32 and the blade groove outer surfaces 201 of the blade grooves 28A of the disk portions 23 facing the first surfaces 100. Accordingly, the balance hole portions 40A having sufficient opening areas can be formed to be recessed on the blade root inner surfaces 101 and the blade groove outer surfaces 201. Therefore, it is possible to decrease the pressure difference between the upstream side Dau and the downstream side Dad of the disk portion 23 in the axial direction Da by the balance hole portions 40A. Therefore, it is possible to decrease the force in the thrust direction acting on the rotor 20.

In addition, if a centrifugal force acts on the rotor blades 32 by rotation about the axis of the rotor shaft 21, the surfaces of the blade roots 36A toward the radially outer side Dro in the engaging protrusion portions 38 and the surfaces of the blade grooves 28A toward the radially inner side Dri in the engaging recessed portion 29 abut on each other, and thus, the rotor blades 32 are supported. In this case, gaps are formed between the blade root inner surfaces 101 of the engaging protrusion portion 38 and the blade groove outer surfaces 201 of the engaging recessed portion 29. Accordingly, the balance hole portions 40A can be formed on the blade root inner surfaces 101 or the blade groove outer surfaces 201 to which the support loads of the rotor blades 32 to which the centrifugal force is applied are not applied.

In addition, in each of the disk portions 23 of the steam turbine 1, a pressure increases as approaching the radially outer side Dro on which the rotor blade 32 is disposed. Accordingly, each of the balance hole portions 40A is formed on the high pressure portion which is disposed on the radially outer side Dro from the bottom portion 28*b* of the blade groove 28A, and thus, it is possible to effectively decrease the pressure difference between the upstream side Dau and the downstream side Dad of the disk portion 23 in the axial direction Da.

In addition, each of the balance hole portions 40A is provided inside the axial fins 35Fa and 35Fb which seal the gap between the rotor blade rows 31 and the stator vane rows 41 adjacent to each other in the axial direction Da, and thus, it is possible to decrease the pressure difference between the upstream side Dau and the downstream side Dad of the disk portion 23 in the axial direction Da, and it is possible to effectively decrease the thrust force in the axial direction Da acting on the rotor 20.

In addition, as the balance hole portion 40A, the recessed portion 41A is formed on the blade root inner surface 101 and the recessed portion 42A is formed on the blade groove outer surface 201. Accordingly, compared to a case where any one of the recessed portion 41A and the recessed portion 42A is formed, it is possible to effectively form the balance hole portion 40A favorably using a space between the blade root 36A and the disk portion 23.

In addition, the communication hole 40C is further provided between the blade grooves 28A adjacent to each other in the circumferential direction Dc, and thus, it is possible to more effectively use the space of the disk portion 23. Accordingly, in addition to the balance hole portions 40A, it is possible to more effectively decrease the pressure difference between the upstream side Dau and the downstream side Dad of the disk portion 23 in the axial direction Da.

In the above-described embodiments, each balance hole portion 40A is formed from the recessed portion 41A formed in each of the engaging protrusion portions 38A, 38B, and 38C of the blade root 36A and the recessed portion 42A formed in each of the engaging recessed portions 29A, 29B, and 29C of the blade groove 28A. However, the present invention is not limited thereto.

For example, the present invention is not limited to the case where the recessed portions 41A and the recessed portions 42A are formed on the blade roots 36A and the blade grooves 28A of all the rotor blades 32 adjacent to each other in the circumferential direction Dc. That is, the recessed portions 41A and the recessed portions 42A may be formed in only some of the rotor blades 32.

In addition, the present invention is not limited to the case where the case where the recessed portions 41A and the recessed portions 42A face each other to form the balance hole portions 40A. That is, the balance hole portion 40A may be formed in only one of the recessed portion 41A and the recessed portion 42A.

In addition, the present invention is not limited to the case where the recessed portions 41A and the recessed portions 42A face each other. That is, the recessed portions 41A and the recessed portion 42A may be formed at any position as long as the positions thereof in the radial direction Dr are different from each other.

In addition, sizes and shapes of the recessed portions 41A and 42A are not limited.

Next, additional embodiments of a steam turbine according to the present invention will be described. Compared to the steam turbine of the above-described embodiments, only a balance hole portion 40B is different.

The balance hole portions 40B of one or more embodiments are formed between the platform 35 and the disk portion. Specifically, the balance hole portions 40B are formed on the rotor outer peripheral surface 23*f*. That is, the balance hole portions 40B are formed only on the rotor outer peripheral surface 23*f* and are not formed on the platform inner peripheral surface 35*f*. In addition, the balance hole portions 40B are not formed in the engaging protrusion portions 38 or the engaging recessed portions 29.

Figure 5:
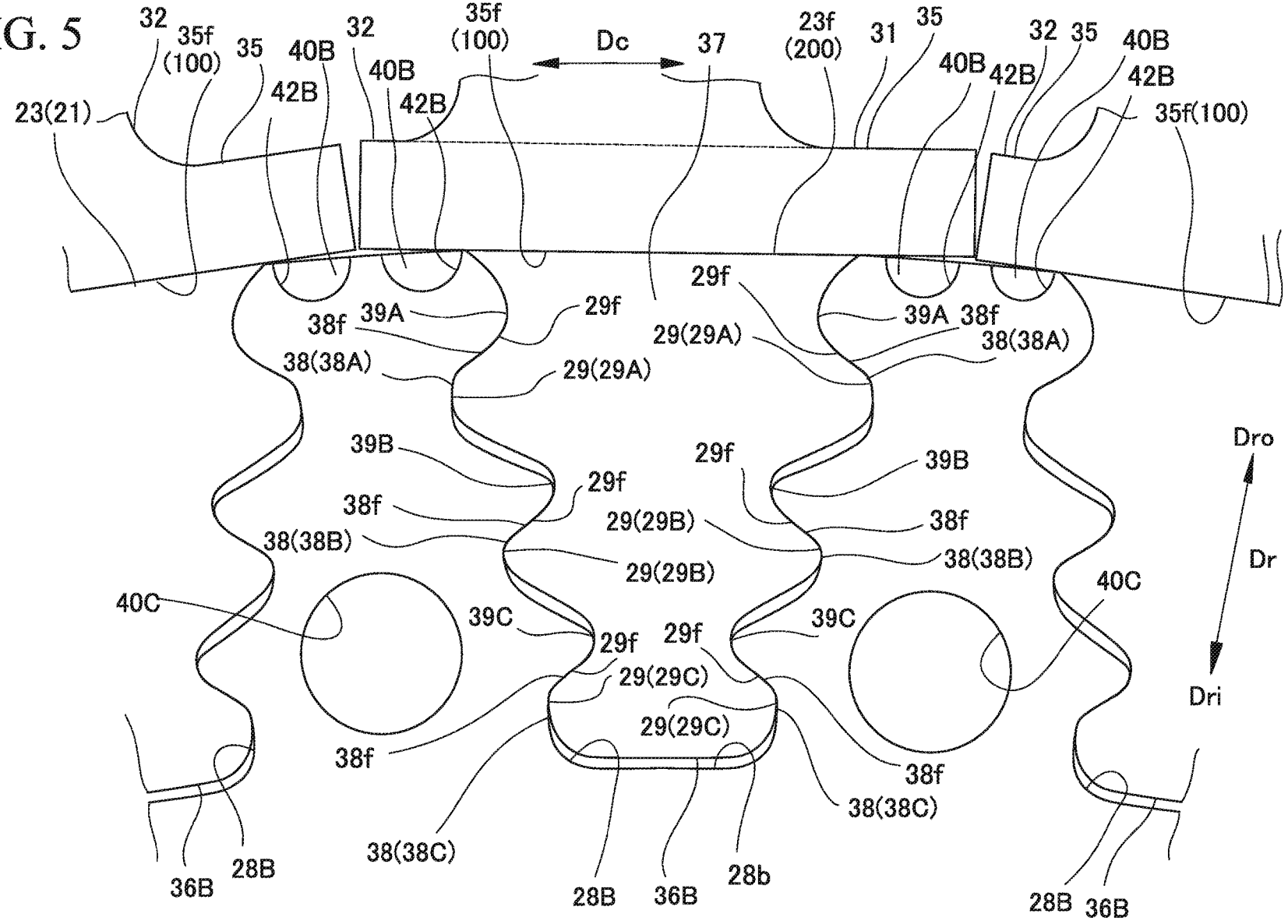
FIG. 5 is a sectional view showing balance hole portions formed in rotor blades and disk portions in an embodiment of the present invention.

As shown in FIG. 5, in each of the rotor blades 32, the platform inner peripheral surface 35*f* the platform 35 is formed as the first surface 100 toward the first direction including a directional component toward the radially inner side Dri. The platform inner peripheral surface 35*f* is toward the first direction.

In addition, the first direction may be any direction as long as it includes the directional component toward the radially inner side Dri, and may be a direction parallel to the radial direction Dr or a direction inclined to the radial direction Dr. The first direction in one or more embodiments is a direction parallel to the radial direction Dr.

In each of the disk portions 23 of the rotor shaft 21, the rotor outer peripheral surface 23*f* is formed as the second surface 200 toward the second direction including a directional component toward the radially outer side Dro. In addition, the second direction may be any direction as long as it includes the directional component toward the radially outer side Dro, and may be a direction parallel to the radial direction Dr or a direction inclined to the radial direction Dr. The second direction in one or more embodiments is a direction parallel to the radial direction Dr.

Recessed portions 42B which are recessed toward the radially inner side Dri are formed on the rotor outer peripheral surface 23*f* of the disk portion 23 at a position facing the platform inner peripheral surface 35*f*.

The balance hole portions 40B which communicate with the upstream side Dau and the downstream side Dad of the disk portion 23 are formed between the platform inner peripheral surface 35*f* of the platform 35 and the disk portion 23 by the recessed portions 42B. Steam flows from the high pressure side (upstream side Dau) of the disk portion 23 to the low pressure side (downstream side Dad) of the disk portion 23 through the balance hole portions 40B. As a result, the pressure difference between the upstream side and the downstream side of the rotor blade row 31 decreases and a force in a thrust direction acting on the disk portion 23 decreases.

In addition, the axial fins 35Fa and 35Fb are formed in the platform 35. Accordingly, steam is prevented from leaking from the gap between the rotor blade row 31 and the stator vane row 41 toward the radially inner side Dri. Accordingly, in one or more embodiments, the balance hole portions 40B are formed on the radially inner side Dri from the axial fins 35Fa and 35Fb.

In addition, in a region of the disk portion 23 on the radially inner side Dri from the platform 35, a pressure increases from the rotor shaft 21 toward the radially outer side Dro. Accordingly, the effects for decreasing the pressure difference by the balance hole portions 40B increase as the balance hole portions 40B are positioned on the radially outer side Dro. Furthermore, the balance hole portions 40B are formed on the rotor outer peripheral surface 23*f* of the disk portion 23, that is, the outermost peripheral portion which is positioned on the radially outermost side Dro in the region of the disk portion 23 of the radially inner side Dri from the axial fins 35Fa and 35Fb.

As described above, a centrifugal force acts on the rotor blades 32 by the rotation about the axis of the rotor shaft 21. Accordingly, the root outer surface 38*f* toward the radially outer side Dro in the engaging protrusion portions 38A, 38B, and 38C of the blade root 36B and the blade groove inner surface 29*f* toward the radially inner side Dri in the engaging recessed portions 29A, 29B, and 29C of the blade groove 28B abut on each other, and thus, the rotor blade 32 is supported.

Meanwhile, a centrifugal force is generated in the rotor blade 32, and thus, a distance between the platform inner peripheral surface 35*f* of the platform 35 and the rotor outer peripheral surface 23*f* of the disk portion 23 increases. As a result, the gap between the platform inner peripheral surface 35*f* and the rotor outer peripheral surface 23*f* increases. Therefore, the support load of the rotor blade 32 to which the centrifugal force is applied does not act on the platform inner peripheral surface 35*f* and the rotor outer peripheral surface 23*f*. Accordingly, the recessed portions 42B are formed on the rotor outer peripheral surface 23*f* as the second surface 200 toward the second direction including a directional component toward the radially outer side Dro, and thus, it is possible to form the balance hole portions 40B having sufficient opening areas. It is possible to decrease the pressure difference between the upstream side Dau and the downstream side Dad of the disk portion 23 in the axial direction Da by the balance hole portions 40B. Therefore, it is possible to decrease the force in the thrust direction acting on the rotor 20.

In addition, each of the balance hole portions 40B is formed on the portion which is disposed on the radially outer side Dro from the bottom portion 28*b* of the blade groove 28B and has a high pressure, and thus, it is possible to effectively decrease the pressure difference between the upstream side Dau and the downstream side Dad of the disk portion 23 in the axial direction Da. Particularly, the recessed portions 42B recessed from the rotor outer peripheral surface 23*f* are provided, and thus, the balance hole portions 40B can be provided on the radially outermost side Dro of the disk portion 23. Accordingly, the balance hole portions 40B can be formed in the portion of the disk portion 23 having the highest pressure, and thus, it is possible to more effectively decrease the pressure difference between the upstream side Dau and the downstream side Dad of the disk portion 23 in the axial direction Da.

In addition, each of the balance hole portions 40B is provided inside the axial fins 35Fa and 35Fb which seal the gap between the rotor blade rows 31 and the stator vane rows 41 adjacent to each other in the axial direction Da, and thus, it is possible to decrease the pressure difference between the upstream side Dau and the downstream side Dad of the disk portion 23 in the axial direction Da, and it is possible to effectively decrease the thrust force in the axial direction Da acting on the rotor 20.

As shown in FIG. 5, in the disk portion 23 of the stator vane row 41, the communication hole 40C which communicates with the upstream side Dau and the downstream side Dad of the disk portion 23 may be provided between the blade grooves 28B adjacent to each other in the circumferential direction Dc. Similar to the balance hole portion 40B, the communication hole 40C is formed on the radially inner side Dri from the axial fins 35Fa and 35Fb and on the radially outer side Dro from the bottom portion 28*b* of the blade groove 28A.

In this way, the communication holes 40C are provided, and thus, it is possible to more effectively decrease the pressure difference between the upstream side Dau and the downstream side Dad of the disk portion 23 in the axial direction Da.

In addition, the present invention is not limited to the above-described embodiments and design can be changed within a scope which does not depart from the gist of the present invention.

For example, it is possible to combine the configurations described in any one of the embodiments with the configurations described in any other embodiment. That is, the steam turbine 1 can include the balance hole portions 40A and the balance hole portions 40B. Of course, the steam turbine 1 may further include the communication holes 40C as described in one or more of the embodiments above.

In addition, the configuration of each portion of the steam turbine 1 can be appropriately modified.

INDUSTRIAL APPLICABILITY

The balance hole portion recessed from at least one of the first surface of the rotor blade and the second surface of the disk portion is provided, and thus, it is possible to decrease the pressure difference between the upstream side and the downstream side of the rotor blade and it is possible to decrease the force in the thrust direction acting on the rotor shaft.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1: steam turbine
10: casing
20: rotor
21: rotor shaft
22: shaft core portion
23: disk portion
23*f*: rotor outer peripheral surface
28A, 28B: blade groove
28*b*: bottom portion (groove bottom portion)
29, 29A, 29B, 29C: engaging recessed portion
29*f*: blade groove inner surface
200: second surface
201: blade groove outer surface

31: rotor blade row
32: rotor blade
33: blade body
34: shroud
35: platform
35Fa, 35Fb: axial fin
35*f*: platform inner peripheral surface
36A, 36B: blade root
38, 38A, 38B, 38C: engaging protrusion portion
38*f*: blade root outer surface
39A: first trunk
39B: second trunk
39C: third trunk
100: first surface
101: blade root inner surface
40A, 40B: balance hole portion
40C: communication hole
41: stator vane row
41A: recessed portion
42: stator vane
42A, 42B: recessed portion
43: outer ring
44: ring body portion
45: ring protrusion portion
46: inner ring
Ar: axis
Da: axial direction
Dad: downstream side
Dau: upstream side
Dc: circumferential direction
Dr: radial direction
Dri: radially inner side
Dro: radially outer side
S: steam

What is claimed is:

1. A steam turbine, comprising:

a rotor shaft comprising:

a shaft core that rotates about an axis; and disk portions that are fixed to the shaft core and expand toward a radially outer side in the shaft core; and a plurality of rotor blades that are fixed to outer peripheries of the disk portions and are disposed in a circumferential direction of the shaft core, wherein each of the rotor blades comprises:

a blade body that extends in a radial direction, a platform on a radially inner side of the blade body, and a blade root on the radially inner side of the platform, wherein the blade root is fitted into a blade groove in each of the disk portions, a first surface, that faces toward a first direction, including a directional component toward the radially inner side of the shaft core is formed on an engaging protrusion of each of the rotor blades, wherein the engaging protrusion protrudes in the circumferential direction from the blade root and engages with an engaging recess disposed on the blade groove, a second surface, that faces toward a second direction, including a directional component toward the radially outer side and facing the first surface is formed on each of the disk portions, a first recess is disposed on the first surface, a second recess is disposed on the second surface, and the first recess and the second recess form a balance hole that decreases a pressure difference between a first side and a second side of each of the disk portions in an axial direction of the disk portions.

2. The steam turbine according to claim 1, wherein in the blade root, as the first surface, a blade root inner surface is formed on the engaging protrusion, and in each of the disk portions, a blade groove outer surface is formed on the engaging recess as the second surface.

3. The steam turbine according to claim 1, wherein the balance hole is disposed on the radially outer side of a groove bottom on the radially innermost side of the blade groove.

4. The steam turbine according to claim 1, wherein in the platform, a platform inner peripheral surface toward the radially inner side is formed as the first surface, in each of the disk portions, a rotor outer peripheral surface that faces the platform inner peripheral surface and is toward the radially outer side is formed as the second surface, and the balance hole is formed on the rotor outer peripheral surface.

5. The steam turbine according to claim 1, wherein in each of the disk portions, a communication hole that communicates in the axial direction is formed between the blade grooves adjacent to each other in the circumferential direction.

* * * * *